US012768547B2

(12) United States Patent
Boman et al.

(10) Patent No.: US 12,768,547 B2
(45) Date of Patent: Oct. 20, 2026

(54) WINDOW HEAT PUMPS WITH MULTIPLE INTERIOR AIR OUTLETS

(71) Applicant: Treau, Inc., San Francisco, CA (US)

(72) Inventors: Daniel B. Boman, San Francisco, CA (US); Rod Mobini, Oakland, CA (US); Arturo Sullivan, Oakland, CA (US); Jason Stein Wexler, San Francisco, CA (US)

(73) Assignee: Treau, Inc., San Francisco, CA (US)

( * ) Notice: Subject to any disclaimer, the term of this patent is extended or adjusted under 35 U.S.C. 154(b) by 85 days.

(21) Appl. No.: 18/884,365

(22) Filed: Sep. 13, 2024

(65) Prior Publication Data

US 2025/0085003 A1 Mar. 13, 2025

Related U.S. Application Data

(60) Provisional application No. 63/538,141, filed on Sep. 13, 2023.

(51) Int. Cl.
*F24F 1/028* (2019.01)
*F24F 1/031* (2019.01)

(52) U.S. Cl.
CPC ..... *F24F 1/028* (2019.02); *F24F 1/031* (2019.02)

(58) Field of Classification Search
CPC ..... F24F 1/028; F24F 1/031; F24F 1/0014; F24F 1/0029; F24F 1/28; F24F 1/38; F24F 13/06; F24F 1/027
See application file for complete search history.

(56) References Cited

U.S. PATENT DOCUMENTS 3,176,474 A * 4/1965 Abbott ..... F24F 1/0003 62/262
5,027,614 A 7/1991 Mori et al.
(Continued)

FOREIGN PATENT DOCUMENTS

CA 2409963 A1 5/2003
KR 20210080821 A 7/2021

OTHER PUBLICATIONS

"Ductless Split Heat Pump" Service Manual—GE Applicances, Mar. 2021.

(Continued)

*Primary Examiner* — Cassey D Bauer
(74) *Attorney, Agent, or Firm* — Polygon IP, LLP

(57) ABSTRACT

Described herein are window heat pumps that are configured to heat or cool building interiors while providing simple installation options. A heat pump may comprise interior, exterior, and interconnecting portions such that the interconnecting portion extends between and mechanically, fluidically, and electrically interconnects the interior and exterior portions. When installed, the interconnecting portion extends through a window and supports the interior and exterior portions relative to each other and the building. The interior and exterior portions protrude below with windowsill thereby reducing obstructions to the window. The interior portion comprises two or more air outlets spaced apart from each other and directing air into the building interior at different angles. For example, a first air outlet may direct air at least in part toward the ceiling, while the second air outlet may direct air along the floor.

20 Claims, 12 Drawing Sheets

(56) References Cited

U.S. PATENT DOCUMENTS

| | | | | |
|---|---|---|---|---|
| 5,046,406 | A * | 9/1991 | Harris | F24F 13/15 454/316 |
| 5,355,688 | A | 10/1994 | Rafalovich et al. | |
| 5,582,025 | A | 12/1996 | Dubin et al. | |
| 6,343,482 | B1 | 2/2002 | Endo et al. | |
| 6,389,834 | B1 | 5/2002 | LeClear et al. | |
| 7,121,105 | B1 | 10/2006 | Rais | |
| 2003/0097854 | A1 | 5/2003 | Cur et al. | |
| 2010/0229585 | A1 | 9/2010 | Bradford et al. | |
| 2013/0040553 | A1* | 2/2013 | Potter | F24F 7/025 454/341 |
| 2014/0020421 | A1 | 1/2014 | Gallo | |
| 2014/0373566 | A1 | 12/2014 | Swiderski | |
| 2015/0202941 | A1 | 7/2015 | Yamamoto et al. | |
| 2015/0354864 | A1 | 12/2015 | Katayama et al. | |
| 2016/0377311 | A1* | 12/2016 | Breed | F24F 13/072 454/333 |
| 2017/0191763 | A1 | 7/2017 | Xu et al. | |
| 2019/0264673 | A1 | 8/2019 | Lynn et al. | |
| 2020/0124296 | A1 | 4/2020 | Baumann et al. | |
| 2020/0238451 | A1 | 7/2020 | Rutkowski et al. | |
| 2021/0078118 | A1 | 3/2021 | Li et al. | |
| 2021/0088251 | A1 | 3/2021 | Martinez Galvan et al. | |
| 2021/0372637 | A1 | 12/2021 | Sharma et al. | |
| 2022/0132838 | A1* | 5/2022 | Kennedy, III | B01D 39/14 |
| 2023/0125880 | A1 | 4/2023 | Analytis et al. | |
| 2023/0126498 | A1 | 4/2023 | Li et al. | |
| 2023/0130691 | A1 | 4/2023 | Shah et al. | |
| 2024/0191931 | A1 | 6/2024 | Tolley et al. | |
| 2025/0198650 | A1 | 6/2025 | Eicher et al. | |
| 2025/0207812 | A1 | 6/2025 | Eicher et al. | |
| 2025/0290663 | A1 | 9/2025 | Wang et al. | |

OTHER PUBLICATIONS

"Axial & Centrifugal Motorized Impellers" Accessed on Sep. 5, 2024: https://continentalfan.com/product-category/oem/motorized-impellers-oem/.

"DLFSFA and DLFLFA Console Ductless System Sizes 12 to 58" Service Manual—Midea Ductless 2018.

"Indoor Unit (Console) AJ009TNJDCH/AA" Service Manual—Samsung Electronics Co., Ltd. 2018.

"Light Commercial Split Systems 3D DC Inverter Heat Pump" Servie Manual—Parker Davis NVAC International, Downloaded on Sep. 5, 2024.

U.S. Appl. No. 18/536,990, Non Final Office Action mailed Jan. 30, 2026, 50 pgs.

* cited by examiner

WINDOW HEAT PUMPS WITH MULTIPLE INTERIOR AIR OUTLETS

CROSS-REFERENCE TO RELATED APPLICATIONS

This application claims the benefit under 35 U.S.C. § 119 (e) of U.S. Provisional Patent Application 63/538,141 by Daniel B. Boman et al, entitled: "Indoor Airflow Design for an Inverted-U Heat Pump", filed on 2023 Sep. 13, which is incorporated herein by reference in its entirety for all purposes.

BACKGROUND

For effective air mixing in a room, fluid dynamics dictates that cold air should be injected toward the top of the room while hot air should be injected toward the bottom of the room. The momentum carries the injected air from the injecting device (e.g., a heat pump, or air conditioner) away from the device (e.g., to the center of the room when the unit is positioned along one of the walls). Thereafter, buoyancy forces take over as the jet of air slows. Specifically, the hot jet rises away from the floor while the cold jet drops toward the floor. A jet can also reach farther into the room if this jet is injected along the surface (e.g., floor, ceiling, wall) as opposed to spaced away from the surface. This fluid dynamic behavior is generally known as a "wall jet".

Conventional window air conditioners have one outlet, e.g., positioned on the top surface of the unit. This configuration has the drawback of only allowing air to be injected along a single direction into the room and/or potentially causing the recirculation of air back into the device inlet thereby limiting room conditioning. For example, hot air, which is provided along the floor, may be desirable in some situations. Split systems may have multiple outlets, but such systems require specialized installation.

SUMMARY

Described herein are window heat pumps that are configured to heat or cool building interiors while providing simple installation options. A heat pump may comprise interior, exterior, and interconnecting portions such that the interconnecting portion extends between and mechanically, fluidically, and electrically interconnects the interior and exterior portions. When installed, the interconnecting portion extends through a window and supports the interior and exterior portions relative to each other and the building. The interior and exterior portions protrude below with windowsill thereby reducing obstructions to the window. The interior portion comprises two or more air outlets spaced apart from each other and directing air into the building interior at different angles. For example, a first air outlet may direct air at least in part toward the ceiling, while the second air outlet may direct air along the floor.

Clause 1. A window heat pump comprising: an interior portion comprising an interior heat exchanger, an interior fan impeller, and an interior motor configured to rotate the interior fan impeller about a principal axis; an exterior portion comprising a compressor, an exterior heat exchanger, and an exterior fan impeller and offset relative to the interior portion along a principal axis; and an interconnecting portion extending between the interior portion and the exterior portion along the principal axis and mechanically, fluidically, and electrically interconnecting the interior portion and the exterior portion, wherein: each of the interior portion and the exterior portion extend away from the interconnecting portion in a direction perpendicular to the principal axis, the interior portion further comprises a first air outlet, a second air outlet, and an air inlet such that the interior heat exchanger and the interior fan impeller are positioned on a fluidic pathway between the air inlet and each of the first air outlet and the second air outlet, the first air outlet is configured to direct a first portion of air exiting the interior portion along a first direction, the second air outlet is configured to direct a second portion of air exiting the interior portion along a second direction, and the first direction is not parallel to the second direction.

Clause 2. The window heat pump of clause 1, wherein: the interior portion comprises a first side, a second side opposite of the first side, and a third side extending between the first side and the second side such that the principal axis extends between the first side and the second side and through the third side, the first direction extends away from the principal axis and toward the first side, and the second direction extends away from the principal axis and toward the second side.

Clause 3. The window heat pump of clause 2, wherein: the first direction forms an angle of 30-60° with the principal axis, and the second direction forms an angle of 0-20° with the principal axis.

Clause 4. The window heat pump of clause 2, wherein: the first side is positioned closer to the first air outlet than to the second air outlet, and the second side is positioned closer to the second air outlet than to the first air outlet.

Clause 5. The window heat pump of clause 4, wherein the air inlet is provided on the third side.

Clause 6. The window heat pump of clause 5, wherein the air inlet is positioned between the first air outlet and the second air outlet.

Clause 7. The window heat pump of clause 4, wherein at least one of the first air outlet and the second air outlet is provided on the third side.

Clause 8. The window heat pump of clause 4, wherein both the first air outlet and the second air outlet are provided on the third side.

Clause 9. The window heat pump of clause 4, wherein the first side is substantially parallel to the principal axis and is operable as a shelf.

Clause 10. The window heat pump of clause 1, wherein the interior portion comprises: a first air duct defining a fluidic path between the interior fan impeller and the first air outlet, and a second air duct defining a fluidic path between the interior fan impeller and the second air outlet.

Clause 11. The window heat pump of clause 10, wherein: the interior fan impeller is configured to direct the first portion of air into the first air duct in a direction substantially perpendicular to the principal axis, and the interior fan impeller is configured to direct the first portion of air into the second air duct in a direction substantially perpendicular to the principal axis.

Clause 12. The window heat pump of clause 10, wherein the interior fan impeller is of a backward curved centrifugal type.

Clause 13. The window heat pump of clause 10, wherein the interior portion comprises a first set of louvers positioned within the first air duct and configured to control a flow rate of the first portion of air through the first air duct.

Clause 14. The window heat pump of clause 13, wherein the first set of louvers is accessible through the first air outlet, is manually adjustable, and collectively pivotable.

Clause 15. The window heat pump of clause 13, wherein the first set of louvers restrict access to the first air duct and prevent contact with the interior fan impeller.

Clause 16. The window heat pump of clause 10, wherein the interior portion comprises a second set of louvers positioned statically within the second air duct and configured to prevent contact with the interior fan impeller.

Clause 17. The window heat pump of clause 10, wherein the interior portion comprises a second set of louvers pivotably supported within the second air duct.

Clause 18. The window heat pump of clause 10, wherein a first line, which is defined by an inner surface of the first air duct and spaced furthest away from the principal axis, is defined by two bends.

Clause 19. The window heat pump of clause 10, wherein a second line, which is defined by an inner surface of the second air duct and spaced furthest away from the principal axis, is defined by one bend.

Clause 20. The window heat pump of clause 1, wherein the interior portion further comprises a filter such that the interior heat exchanger is positioned between the filter and the interior fan impeller.

Clause 21. The window heat pump of clause 20, wherein the filter has a minimum efficiency reporting value of at least 13.

Clause 22. The window heat pump of clause 1, wherein the interior portion further comprises a fan shroud surrounding the interior fan impeller and comprising two protruding deflectors.

Clause 23. The window heat pump of clause 1, wherein the exterior portion is pivotably coupled to the interior portion by the interconnecting portion.

Clause 24. The window heat pump of clause 1, wherein the interconnecting portion is configured to change a gap between the interior portion and the exterior portion along the principal axis.

These and other embodiments are described further below with reference to the figures.

BRIEF DESCRIPTION

The included drawings are for illustrative purposes and serve only to provide examples of possible structures and operations for the disclosed inventive systems and devices. These drawings in no way limit any changes in form and detail that may be made by one skilled in the art without departing from the spirit and scope of the disclosed implementations.

DETAILED DESCRIPTION

Introduction

Figure 1A:
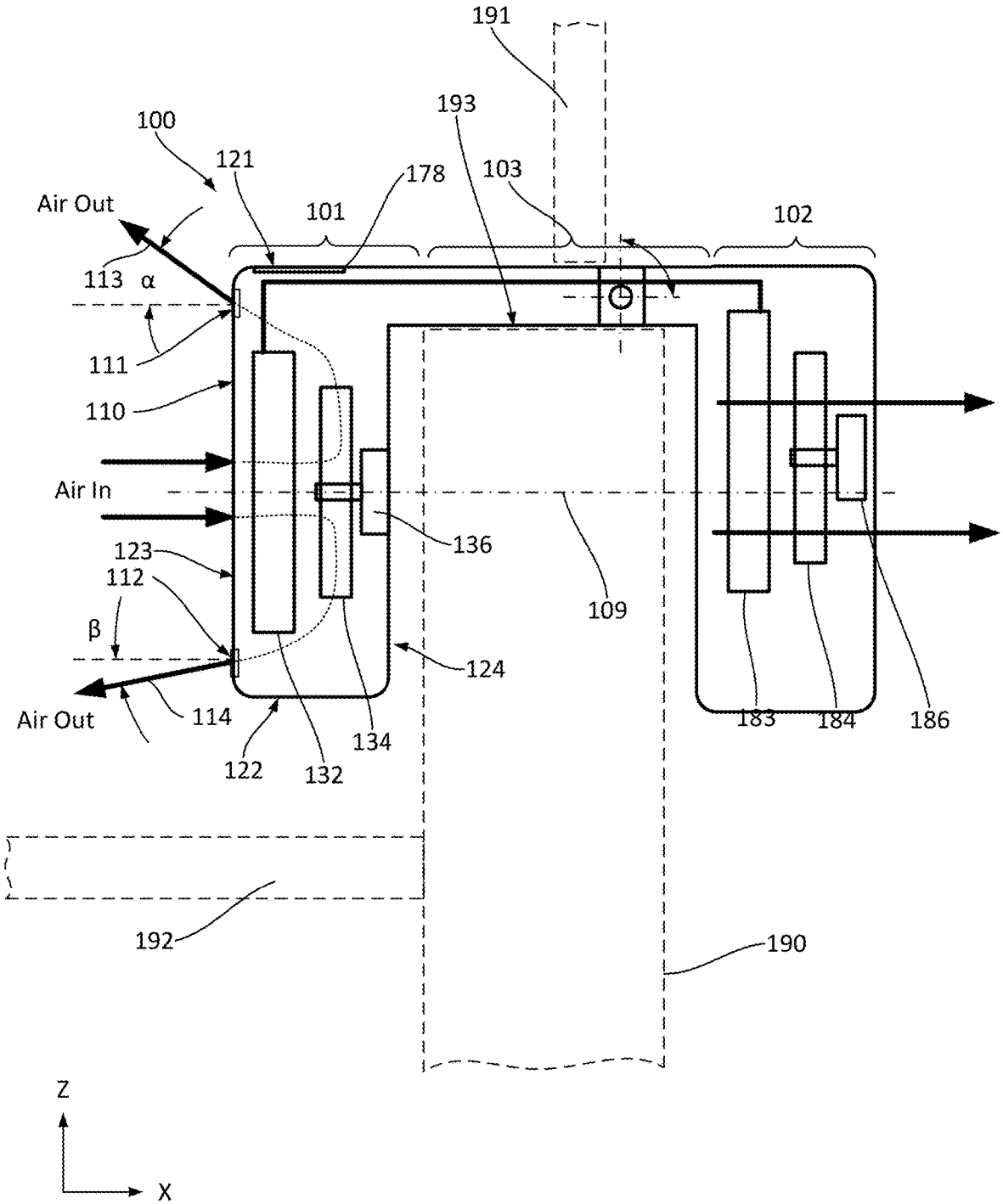
FIG. 1A is a side schematic view of a window heat pump comprising an interior portion, exterior, and interconnecting portion illustrating the position of the window heat pump relative to the building wall, floor, and window, in accordance with some examples.

A window heat pump may be used for heating and cooling a building interior while protruding through the window and being supported by the windowsill. Specifically, when installed, the interior portion of the window heat pump is positioned inside the building, while the exterior portion is positioned outside the building. The interconnecting portion extends through the window opening between the interior and exterior portions and mechanically, fluidically, and electrically interconnects the interior and exterior portions. For example, the interconnecting portion may route refrigerant lines, condensate line, electrical power wiring, electrical control wiring, and the like between the interior and exterior portions. In a specific example, the interior portion comprises a power cord for connecting the window heat pump to an outlet (inside the building). The power is then shared with the exterior portion through the interconnecting portion to operate various power components of the exterior portion, such as a compressor, fan motor, and the like. In the same or other examples, condensate, which is collected within the interior unit when the window heat pump is operated in cooling mode may be transferred to the exterior unit for disposal to the environment. A refrigerant is cycled between the interior and exterior unit and determines the heating and cooling modes of the interior unit.

As noted above, the interconnecting portion may be supported by a windowsill. Furthermore, the interconnecting portion may support the interior and exterior portions (relative to the building). As such, the interior and exterior portions do not need to be directly and independently attached to the building. The interior and exterior portions may protrude below the windowsill to reduce the obstruction to the window. In some examples, a portion of the window heat pump protruding above the windowsill has a height of less than 30% or even less than 20% of the overall heat pump height. Overall, a window heat pump has a saddle shape or, more specifically, a saddle-bags shape, which can be also referred to as an inverted-U shape. Finally, the interconnecting portion may allow the exterior portion to tilt relative to the interior portion, e.g., during the installation of the window heat pump over a windowsill. In the same or other examples, the interconnecting portion may allow for a change in the gap between the interior portion and exterior portion, e.g., to accommodate different widths of windowsills.

Since a window is usually positioned near the center of the wall (in the vertical orientation), the interior portion protrudes toward the floor (from the interconnecting portion) such that the bottom of the interior portion may be positioned proximate to the floor. This position allows delivering at least one air stream (from an air outlet positioned near the bottom of the interior portion) along the floor surface. The top surface of the interior portion is positioned above the windowsill and is closer to the room height's midpoint thereby allowing to deliver another air stream away from the floor, e.g., toward the ceiling. In other words, the interior portion may inject air toward the ceiling (e.g., in a cooling mode) using a first air outlet. Furthermore, the interior portion may inject air along the floor (e.g., in heating mode) using a second air outlet. In general, one or both outlets can be open (e.g., using one or more sets of internal louvers) in a cooling mode, heating mode, or fan-only mode depending on the user's input.

Examples of Window Heat Pumps

FIG. 1A is a schematic side view of a window heat pump 100 comprising an interior portion 101, an exterior portion 102, and an interconnecting portion 103, in accordance with some examples. FIG. 1A also illustrates a building wall 190, a window 191, and a floor 192, which are provided as references to illustrate the installation environment of the window heat pump 100. One having ordinary skill in the art would appreciate that the building wall 190, window 191, and floor 192 are not parts of the window heat pump 100. Furthermore, it should be noted that the interior portion 101, exterior portion 102, and interconnecting portion 103 are not specific components or units of the window heat pump 100 but simply arbitrarily identified portions/sections of the window heat pump 100 to illustrate the spatial orientations of these portions relative to each other and relative to the building wall 190, window 191, and floor 192. Some components (e.g., enclosures) may be shared by two or all three of the interior portion 101, exterior portion 102, and interconnecting portion 103.

The interior portion 101 comprises an interior heat exchanger 132, interior fan impeller 134, and an interior motor 136 configured to rotate the interior fan impeller 134 about a principal axis 109. The interior portion 101 further comprises a first air outlet 111, a second air outlet 112, and an air inlet 110 such that the interior heat exchanger 132 and the interior fan impeller 134 are positioned on the fluidic pathway between the air inlet 110 and each of the first air outlet 111 and the second air outlet 112. Specifically, FIG. 1A illustrates an example in which the interior portion 101 comprises a single air inlet 110 positioned between the first air outlet 111 and the second air outlet 112. However, other positions and the number of air inlets as well as the number of air outlets are within the scope and described below.

Referring to FIG. 1A, when the window heat pump 100 is installed, the first air outlet 111 is positioned further away from the floor 192 than the second air outlet 112. As such, the first air outlet 111 may be referred to as a top air outlet or a top air vent. The second air outlet 112 may be referred to as a bottom air outlet or a bottom air vent. It should be noted that prior to installation of the window heat pump 100, the top and bottom outlets/vents may have any orientation relative to the gravitational vertical. The top and bottom (or first and second) are designed to simply differentiate the two air outlets.

Referring to FIG. 1A, the first air outlet 111 is configured to direct a first portion of air exiting the interior portion 101 along the first direction 113. The second air outlet 112 is configured to direct a second portion of air exiting the interior portion 101 along the second direction 114. The first direction 113 is not parallel to the second direction 114. For example, the first direction 113 is away from the floor 192, while the second direction 114 may be toward or parallel to the floor 192. Prior to the installation, these directions may be defined relative to the sides of the air inlet 110. It should be noted that the first direction 113 and the second direction 114 may have a directional component along/parallel to the principal axis 109 and a directional component perpendicular to the principal axis 109. These perpendicular directional components of the first direction 113 and the second direction 114 extend away from each other (extend in the opposite direction). The parallel directional components of the first direction 113 and the second direction 114 extend in the same direction (away from the window heat pump 100).

Specifically, the interior portion 101 comprises a first side 121, a second side 122 opposite of the first side 121, and a third side 123 extending between the first side 121 and the second side 122. The principal axis 109 may extend between the first side 121 and the second side 122 and through the third side 123. Furthermore, the third side 123 may face away from the exterior portion 102. The interior portion 101 may also comprise a fourth side 124, opposite of the third side 123 and facing the exterior portion 102. The fourth side 124 may extend between the second side 122 and the interconnecting portion 103.

Figure 1B:
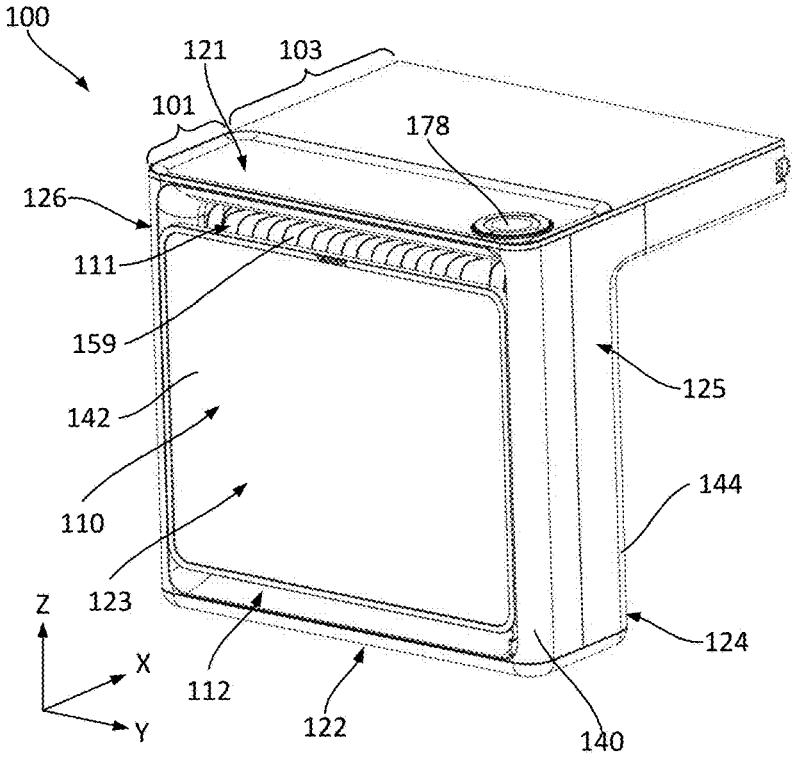
FIG. 1B is a perspective view of the interior portion of the window heat pump in FIG. 1A illustrating the third side operable as an air inlet and further illustrating a first set of louvers positioned past the first air outlet, in accordance with some examples.

In some examples, as shown in FIG. 1A, the first side 121 is positioned closer to the first air outlet 111 than to the second air outlet 112. The second side 122 is positioned closer to the second air outlet 112 than to the first air outlet 111. In the same or other examples, the air inlet 110 is positioned between the first air outlet 111 and the second air outlet 112. In other words, the first air outlet 111 is positioned closer to the first side 121 than to the second side 122. The second air outlet 112 is positioned closer to the second side 122 than to the first side 121. However, other orientations of the first air outlet 111, the second air outlet 112, and air inlet 110 are also within the scope and described below with reference to FIGS. 4A-4D and 5A-5B. For example, the first air outlet 111 may not overlap with the first side 121, may partially overlap with the first side 121 (e.g., extend through the corner formed by the first side 121 and the third side 123), or fully overlap with the first side 121. Similarly, the second air outlet 112 may not overlap with the second side 122, may partially overlap with the second side 122 (e.g., extend through the corner formed by the second side 122 and the third side 123), or fully overlap with the second side 122. In other examples, one or both of the first air outlet 111 and second air outlet 112 at least partially overlap with fifth side 125 and sixth side 126 of the interior portion 101, which extend between the first side 121 and second side 122 and which may parallel to the principal axis 109 and perpendicular to each of the first side 121, second side 122, third side 123, and fourth side 124. The orientation of all sides is shown in FIG. 1B.

Referring to FIG. 1A, the first direction 113 may extend away from the principal axis 109 and toward the first side 121 (i.e., referring to the component of the first direction 113 that is perpendicular to the principal axis 109). The second direction 114 may extend away from the principal axis 109 and toward the second side 122 (i.e., also referring to the component of the second direction 114 that is perpendicular to the principal axis 109). In other words, the first direction 113 and second direction 114 (or more specifically their components perpendicular to the principal axis 109) extend from the principal axis 109 in different directions (up and down). In some examples, the first direction 113 forms an angle of 30-60° with the principal axis 109 or, more specifically, 35-55°, 40-50°, or about 45°. In the same or other examples, the second direction 114 forms an angle of 0-20° with the principal axis 109 or, more specifically, 5-15°, or about 10°. It should be noted that when the angle between the second direction 114 and the principal axis 109 approaches 0°, the "wall jet" effect becomes stronger allowing the second air portion to reach further into the room (and away from the building wall 190). However, when this angle is close to 0° (e.g., less than 5° or even less than 3°), there is an increased portion of air that may bypass the majority of the room and recirculate back into the air inlet 110 of the interior portion 101. As such, in some examples, this angle may be at least 3° or even at least 5° (and not a negative angle). In further examples, the angle between the first direction 113 and the second direction 114 may be 30-80° or, more specifically, 40-70°, or 50-60°.

In some examples, the angle between the first direction 113 and the principal axis 109 may be fixed at least within a vertical plane, i.e., X-Z plane. The vertical plane may be also defined as a plane containing the principal axis 109 and extending parallel to the fifth side 125 and/or sixth side 126 (and, in some examples, perpendicular to the first side 121, second side 122, and/or third side 123). In other words, there may be no up/down adjustment of the first set of louvers 159. However, the left/right adjustment of the first set of louvers 159 may be still provided, e.g., about axes parallel to the Z-axis. Similarly, the angle between the second direction 114 and the principal axis 109 may not have the up/down adjustment but may have the left/right adjustment. Alternatively, at least one of these angles or both angles may be adjustable, e.g., using louvers positioned at the first air outlet 111 and/or the second air outlet 112. These directional adjustments may help optimize performance in when switching between heating versus cooling operating modes. Furthermore, these directional adjustments may be in addition to the flow rate adjustments through each of the first air outlet 111 and second air outlet 112. It should be noted that the same set of louvers that adjust the first direction 113 or/the second direction 114 can also adjust the flow rate through the corresponding air outlet by causing increased flow resistance at certain angles of the louvers.

Referring to FIG. 1A, the exterior portion 102 is offset relative to the interior portion 101 along the principal axis 109 thereby forming a gap between these portions, bridged by the interconnecting portion 103. The exterior portion 102 is configured to supply or remove heat from the interior portion 101 using compressed refrigerant as further described below. The exterior portion 102 comprises at least an exterior heat exchanger 183, exterior fan impeller 184, and exterior motor 186. The exterior heat exchanger 183 is fluidically coupled to the interior heat exchanger 132. The exterior motor 186 is configured to rotate the exterior fan impeller 184 to force the air (from the environment outside of the building) to either heat or cool the exterior heat exchanger 183.

Referring to FIG. 1A, the interconnecting portion 103 extends between the interior portion 101 and the exterior portion 102 along the principal axis 109 and mechanically, fluidically, and electrically interconnects the interior portion 101 and the exterior portion 102. Specifically, during the installation of the window heat pump 100, the interconnecting portion 103 may be positioned onto and supported by the windowsill (defining the interface between the window opening and the building wall 190). In turn, the interconnecting portion 103 may support the interior portion 101 and the exterior portion 102 thereby eliminating the need for separately securing the interior portion 101 and the exterior portion 102 to the building. In fact, in some examples, one or both of the interior portion 101 and the exterior portion 102 may be spaced away from the building wall 190.

In some examples, the first side 121 is substantially parallel to the principal axis 109 and is operable as a shelf. In these examples, the first air outlet 111 may be positioned away from the first side 121 (e.g., on the third side 123) to prevent foreign objects from falling into the duct forming the first air outlet 111.

FIG. 1B is a perspective view of the interior portion 101 of the window heat pump 100 in FIG. 1A, in accordance with some examples. A portion of the interconnecting portion 103 is shown as a reference. The first side 121 may include a user interface 178, e.g., for turning on/off the window heat pump 100, switching the operating regimes (cooling and heating), changing the fan speed, and other functions. As noted above, the first side 121 may be also operable as a shelf. FIG. 1A also illustrates a first set of louvers 159 positioned within a first air duct 150 behind the first air outlet 111. The structure and operation of these and other louvers are described below.

The third side 123 may be defined by a filter cover 142, which forms an air inlet 110 and supports an air filter 130 (when one is used) in the interior portion 101. As such, the interior heat exchanger 132 may be positioned along the fluidic pathway between the filter 130 and the interior fan impeller 134. The filter cover 142 may be adjustable to accommodate air filters with different thicknesses. The filter cover 142 may be supported on the bell mouth 146 and condensate tray 133.

In some examples, the interior portion 101 may include an enclosure 140 and a back panel 144, collectively forming the first side 121, second side 122, fifth side 125, and sixth side 126. The fourth side 124 may formed entirely by the back panel 144. However, other examples are within the scope. In this example, the enclosure 140 forms (at least in part) the first air outlet 111 and the second air outlet 112, which are in the form of parallel slots (extending along the Y axis).

Figure 1C:
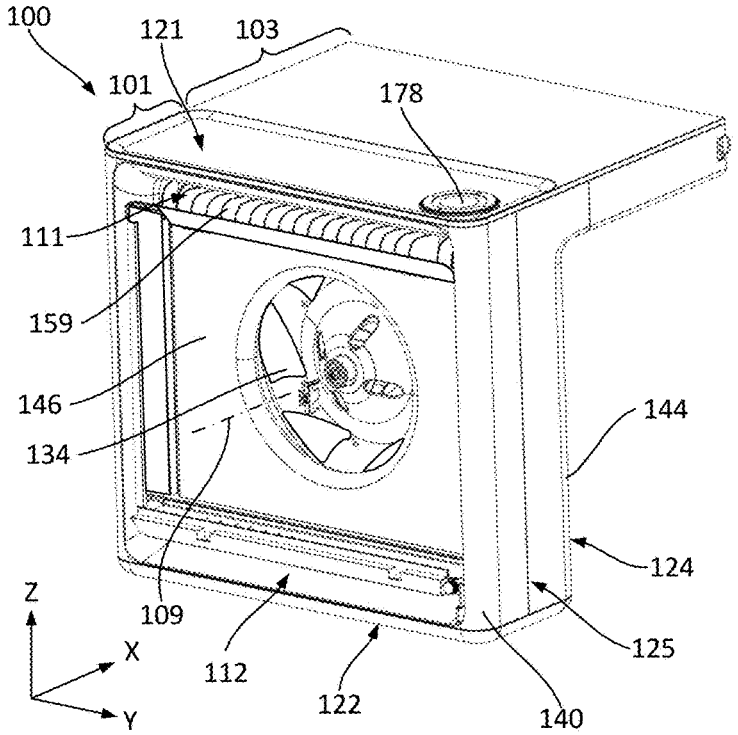
FIG. 1C is a perspective view of the interior portion in FIG. 1B with several components removed to illustrate internal components of the interior portion such as interior fan impeller and a fan shroud, in accordance with some examples.

FIG. 1C is a perspective view of the interior portion 101 in FIG. 1B with several components removed to illustrate internal components of the interior portion 101, in accordance with some examples. Specifically, FIG. 1A illustrates a bell mouth 146 and an interior fan impeller 134. The bell mouth 146 is positioned between the interior heat exchanger 132 and the interior fan impeller 134 and focuses the incoming air to the center of the interior fan impeller 134.

Figure 1D:
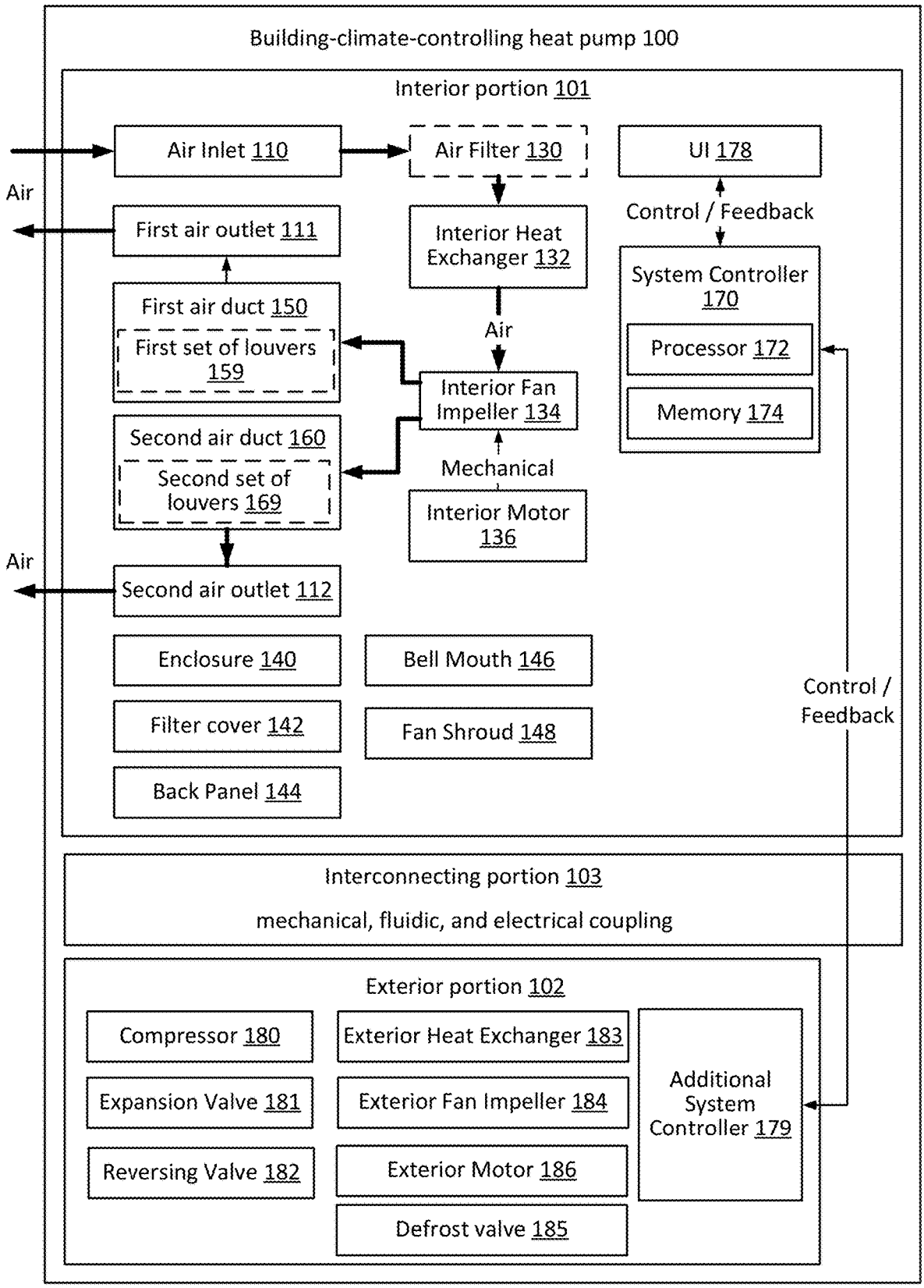
FIG. 1D is a block diagram of a window heat pump, in accordance with some examples.

FIG. 1D is a block diagram of a window heat pump 100, in accordance with some examples. For example, the window heat pump 100 may include a system controller 170, which comprises a processor 172 and a memory 174 and is communicatively coupled to various components of the interior portion 101 and exterior portion 102. The window heat pump 100 may include a single system controller 170 or a combination of two controllers (e.g., a system controller 170 provided in the interior portion 101 and a separate additional system controller 179 provided in the exterior portion 102), in which case the two controlled are communicatively coupled. For example, the system controller 170 and/or the separate additional system controller 179 may control the speed of the interior motor 136 (and determine the power drawn by the interior motor 136). In some examples, the interior portion 101 may include one or more temperature sensors (not shown) that provide input to the system controller 170 and/or the separate additional system controller 179. The system controller 170 and/or the separate additional system controller 179 may also control the speed of an exterior motor 186 as well as the speed of a compressor 180, the operation of an expansion valve 181, and a reversing valve 182 (provided in the exterior portion 102).

Figure 1E:
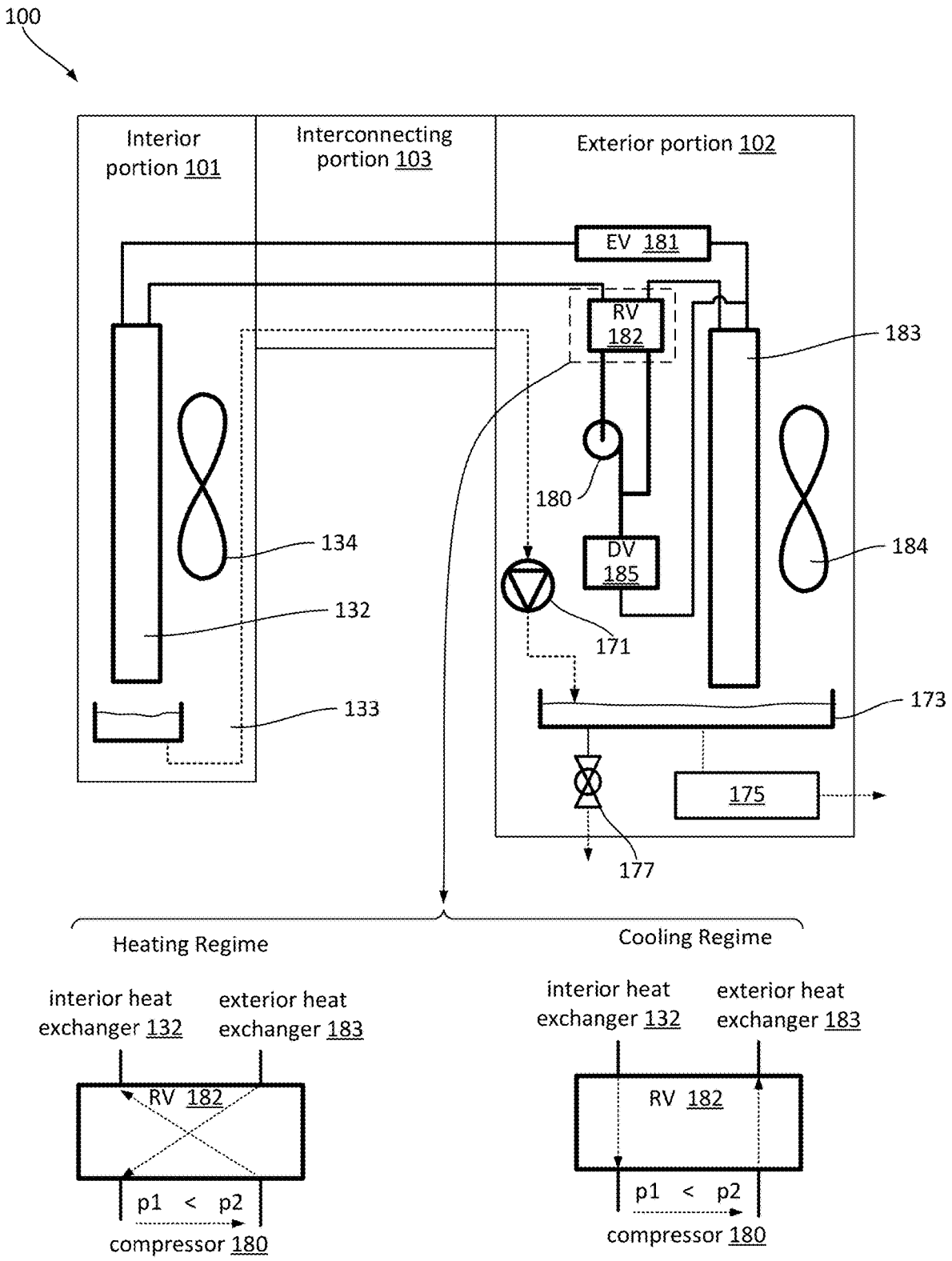
FIG. 1E is a fluidic diagram of a window heat pump, in accordance with some examples.

FIG. 1E is a fluidic diagram of a window heat pump 100, in accordance with some examples. Unlike a conventional air conditioning system, the window heat pump 100 comprises a reversing valve 182 that enables heating and cooling modes. In a heating mode, the reversing valve 182 is configured to maintain the refrigerant at a lower pressure in the exterior heat exchanger 183 than in the interior heat exchanger 132. Specifically, the compressed refrigerant (exiting the compressor 180) is sent to the interior heat exchanger 132 before passing through the expansion valve 181 and returning to the exterior heat exchanger 183. As a result, the exterior heat exchanger 183 is maintained at a temperature lower than in the environment (outside the building), while the interior heat exchanger 132 is operated at a temperature higher than the interior of the building. Collectively, this causes the transfer of heat from the environment to the interior.

In a cooling mode, the reversing valve 182 is configured to maintain the refrigerant at a higher pressure in the exterior heat exchanger 183 than in the interior heat exchanger 132. Specifically, the compressed refrigerant (exiting the compressor 180) is sent to the exterior heat exchanger 183 before passing through the expansion valve 181 and returning to the interior heat exchanger 132. As a result, the exterior heat exchanger 183 is maintained at a temperature higher than in the environment (outside the building), while the interior heat exchanger 132 is operated at a temperature lower than the interior of the building. Collectively, this causes the transfer of heat from the interior to the environment. FIG. 1E also illustrates an optional defrost valve 185, which can shut down the flow through the interior heat exchanger 132 upon detecting certain conditions.

In some examples, the window heat pump 100 comprises various components for managing condensate, e.g., formed on the interior heat exchanger 132 while the window heat pump 100 operates in a cooling regime and the water (from the interior air) condenses on the interior heat exchanger 132. The condensate may drip from the interior heat exchanger 132 to a condensate tray 133 and may be pumped (e.g., using a condensate pump 171) to a meltwater reservoir 173 (in the exterior portion 102). The meltwater reservoir 173 may be also used to collect condensate and melted water from the exterior heat exchanger 183 (e.g., when the window heat pump 100 operates in a heating regime). The water may be released from the meltwater reservoir 173 using a meltwater valve 177 and/or dispersed into the environment using a meltwater atomizer 175, or it may be drained through a static opening without a valve.

Figure 1F:
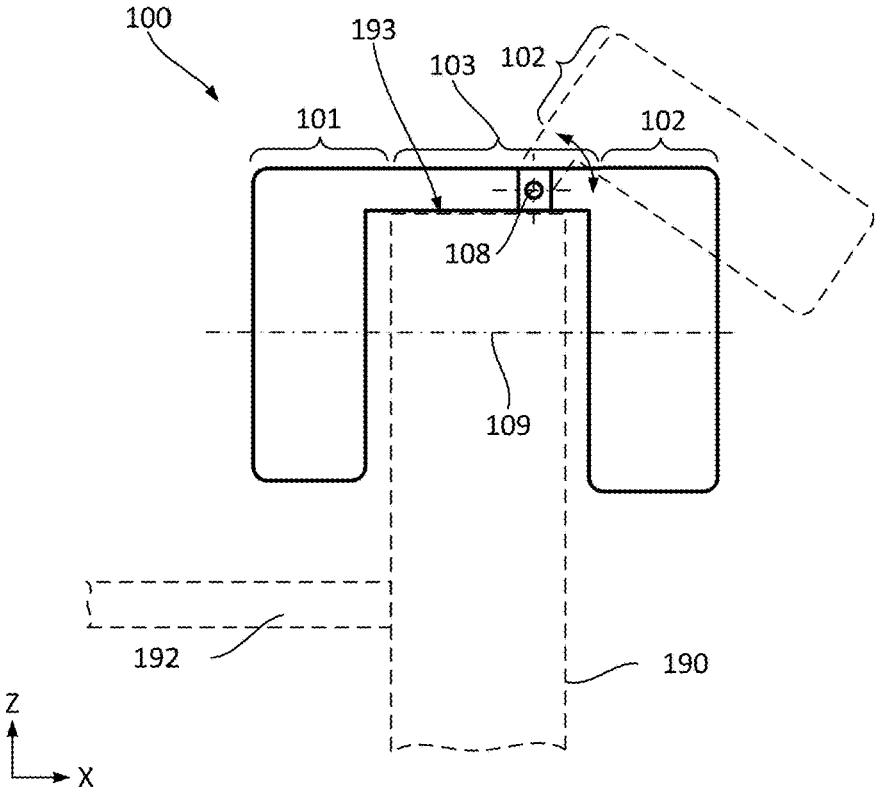
FIG. 1F is a side schematic view of a window heat pump illustrating the exterior portion pivoting relative to the interior portion during the installation of the window heat pump over the windowsill, in accordance with some examples.

Referring to FIG. 1F, in some examples, the exterior portion 102 is pivotably coupled to the interior portion 101 by the interconnecting portion 103. This pivotable feature helps during the installation of the window heat pump 100 over a windowsill 193. In some examples, the exterior portion 102 is configured to pivot relative to the interior portion 101 up to about 90° (e.g., about a pivot axis 108).

Figure 1G:
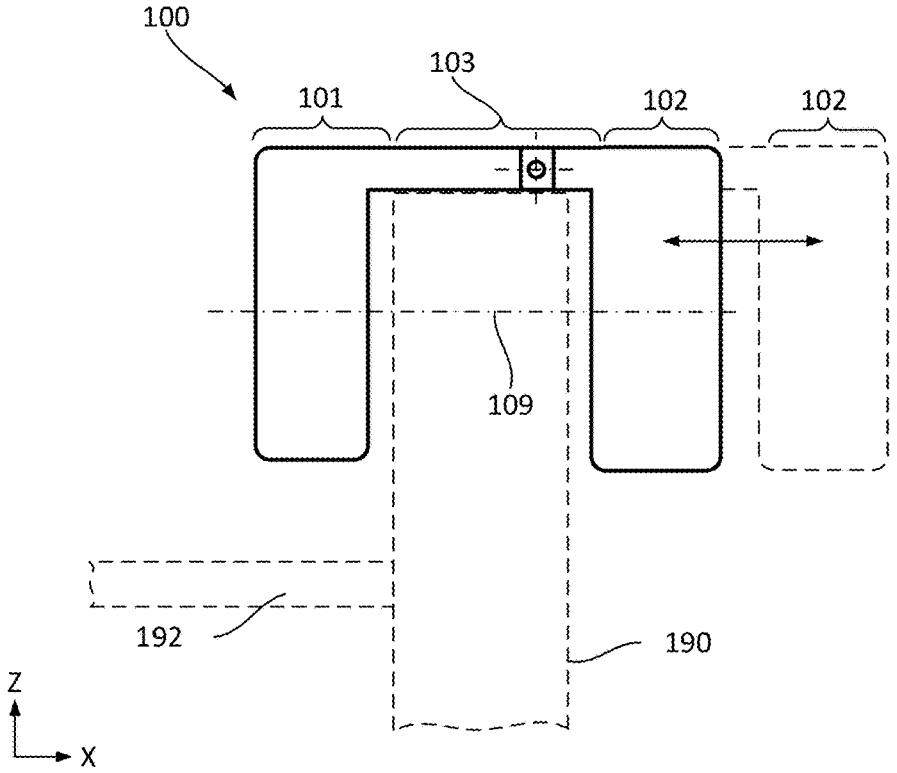
FIG. 1G is a side schematic view of a window heat pump illustrating the gap between the interior and exterior portions being adjusted during the installation of the window heat pump over the windowsill, in accordance with some examples.

Referring to FIG. 1G, in some examples, the interconnecting portion 103 is configured to change a gap between the interior portion 101 and the exterior portion 102 along the principal axis 109. This extension feature enables the installation of the window heat pump 100 over a windowsill 193 having different widths (measured along the X direction). In some examples, the window heat pump 100 is configured to change the gap to accommodate window sills and/or wall thickness of 10-71 cm (4-28 inches) or, more specifically, 15-50 cm (6-20 inches).

Examples of Air Ducts

Figure 2A:
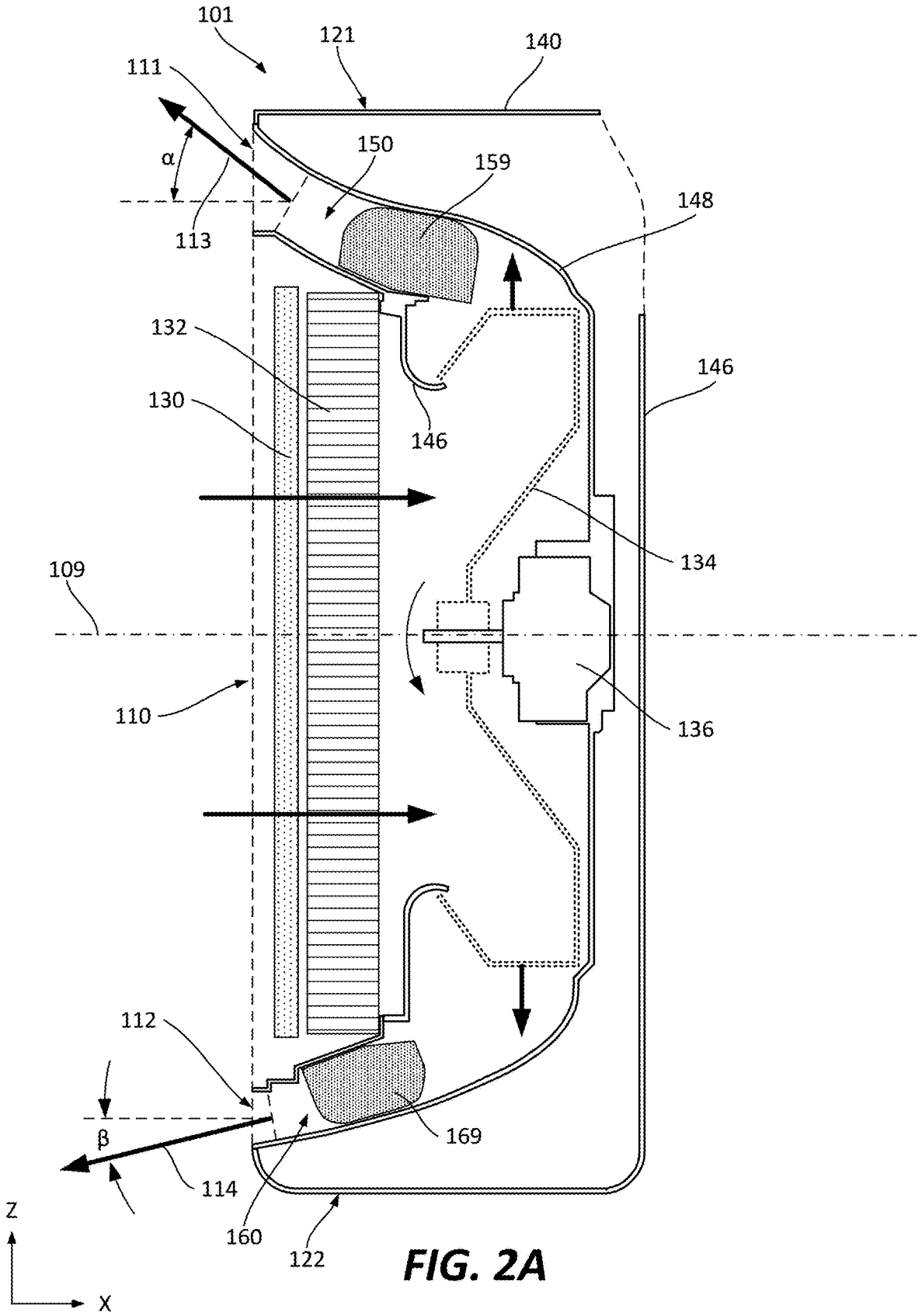
FIG. 2A is a side schematic view of the interior portion of a window heat pump illustrating the first and second air outlets formed by the first and second air ducts, in accordance with some examples.

FIG. 2A is a side schematic view of the interior portion 101 of a window heat pump 100 illustrating a first air outlet 111 and a second air outlet 112 as well as interior fan impeller 134, in accordance with some examples. The interior portion 101 comprises a first air duct 150 defining a fluidic path between the interior fan impeller 134 and the first air outlet 111. The interior portion 101 also comprises a second air duct 160 defining a fluidic path between the interior fan impeller 134 and the second air outlet 112. Each of the first air duct 150 and the second air duct 160 may be formed by one or more components of the air inlet 110 such as a fan shroud 148, a bell mouth 146, and the like. The shape of the first air duct 150 determines the first direction 113 (of the first air portion of the first air outlet 111). Similarly, the shape of the second air duct 160 determines the second direction 114 (of the second air portion of the first air outlet 111). Specifically, each of the first air duct 150 and the second air duct 160 is specially configured/shaped to redirect the corresponding air portion from the interior fan impeller 134 to the corresponding air outlet.

Figure 2B:
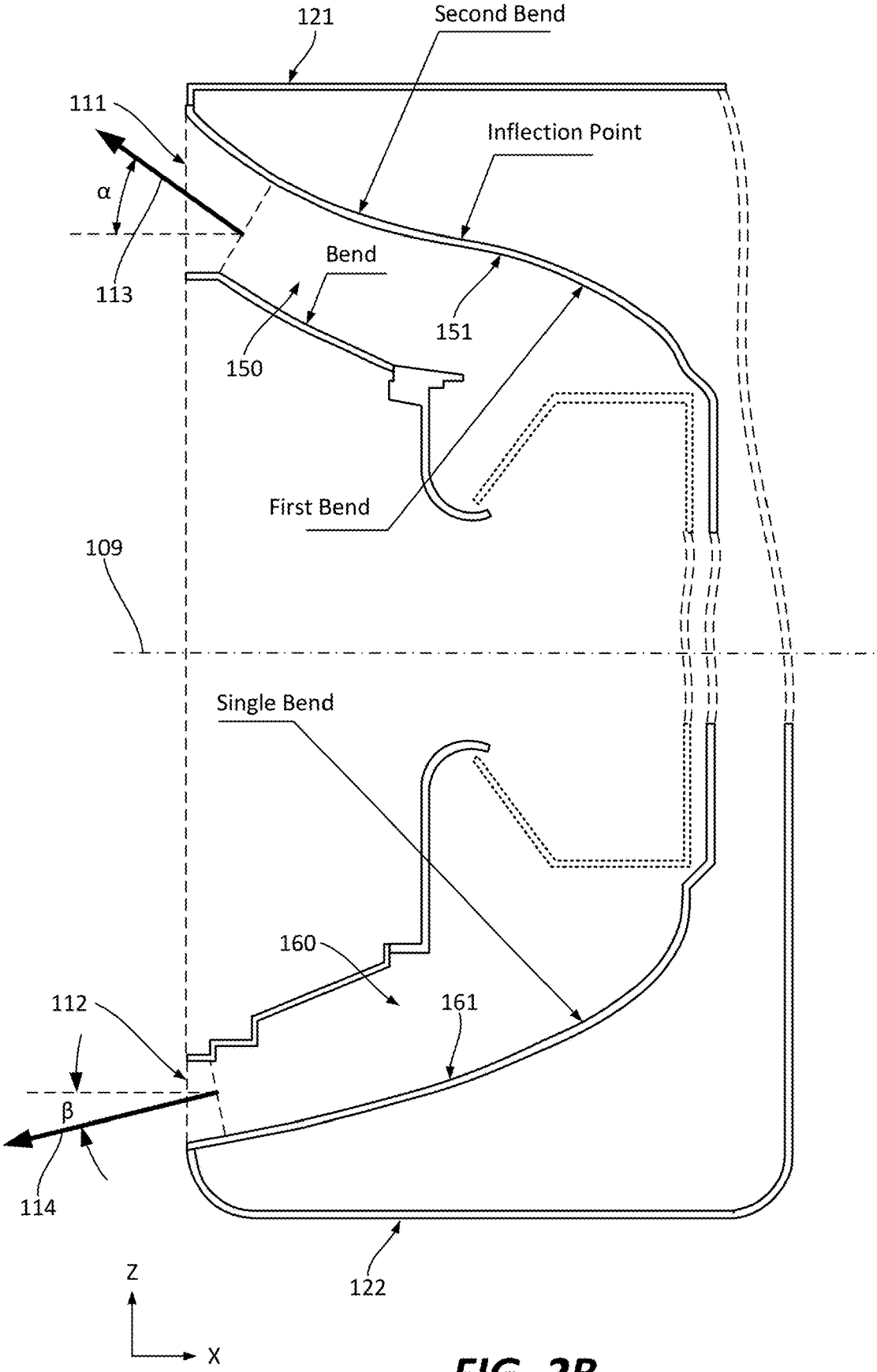
FIG. 2B is a side schematic view of the interior portion in FIG. 2A focusing on the internal surfaces of the first and second air ducts, in accordance with some examples.
Figure 3A:
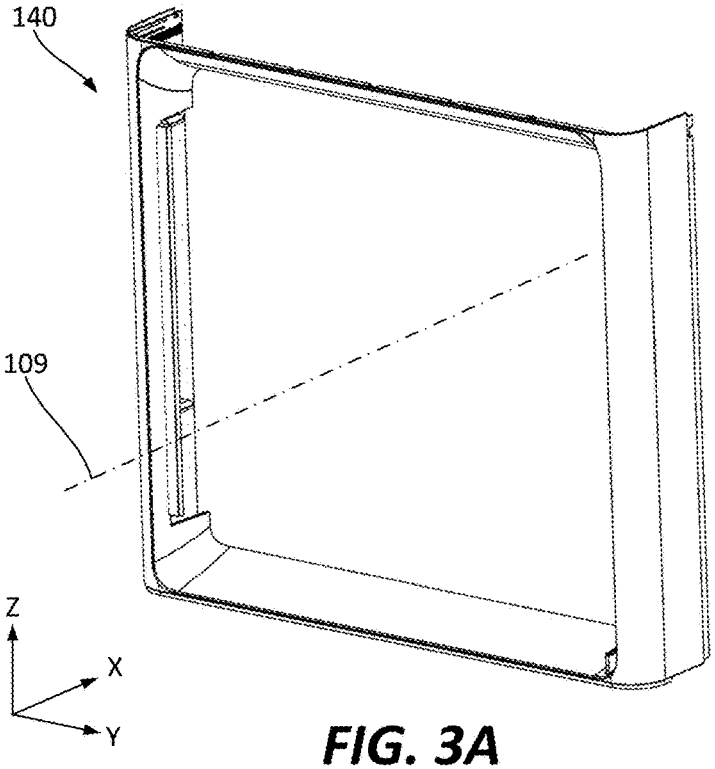
FIG. 3A is a perspective view of the enclosure of the interior portion, in accordance with some examples.
Figure 3B:
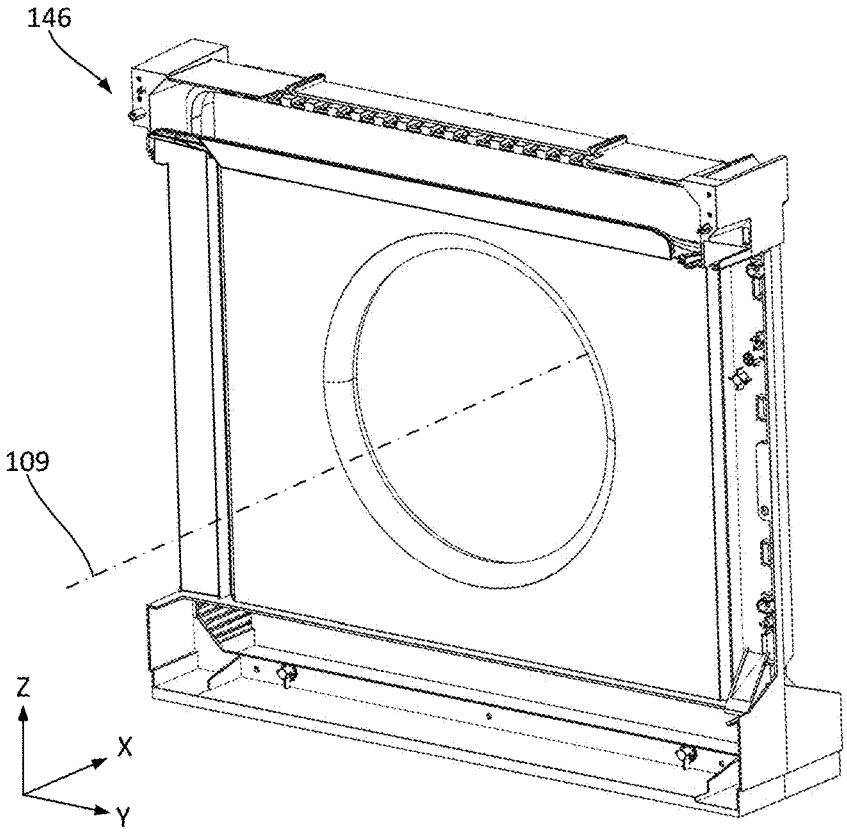
FIG. 3B is a perspective view of the bell mouth of the interior portion, in accordance with some examples.

Referring to FIGS. 2A and 2B, a first line 151, which is defined by an inner surface of the first air duct 150 and spaced furthest away from the principal axis 109, is defined by two bends. A second line 161, which is defined by an inner surface of the second air duct 160 and spaced furthest away from the principal axis 109, is defined by one bend. FIG. 3A is a perspective view of the enclosure 140, in accordance with some examples. Furthermore, FIG. 3B is a perspective view of the bell mouth 146, in accordance with some examples.

Figure 3C:
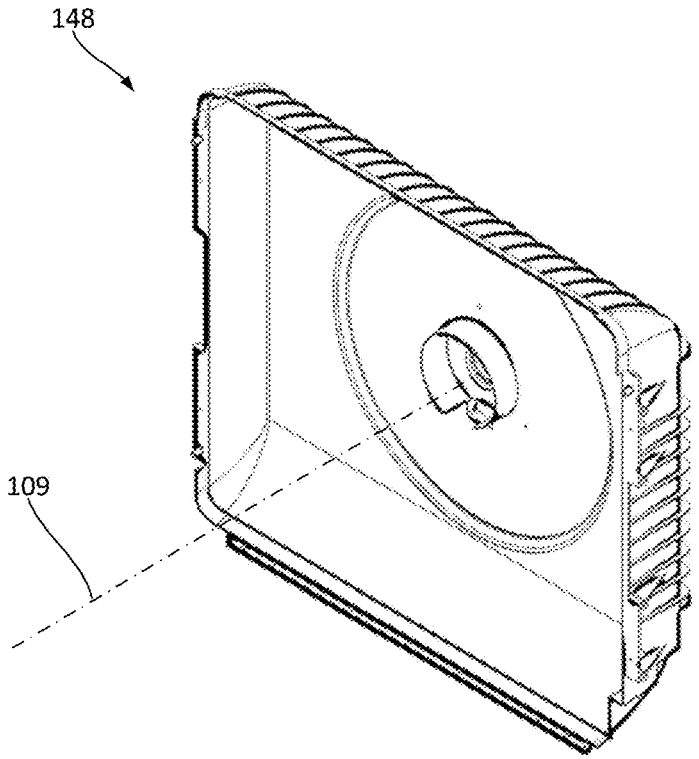
FIGS. 3C and 3D are perspective views of two examples of the fan shroud of the interior portion.
Figure 3D:
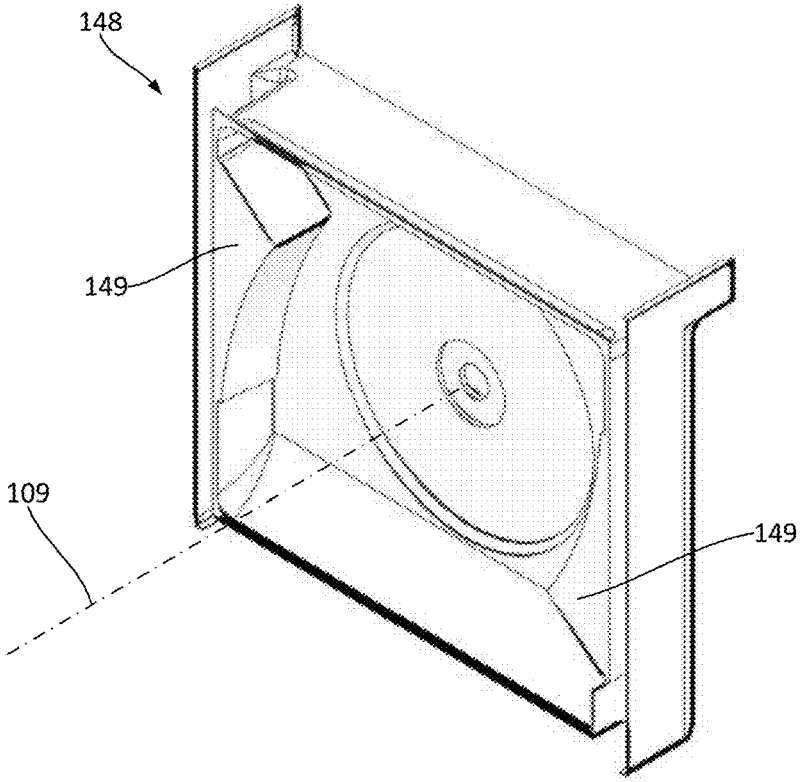

FIGS. 3C and 3D are perspective views of two examples of the fan shroud 148. The fan shroud 148 is configured to surround the interior fan impeller 134 and may comprise two protruding deflectors 149, e.g., as shown in FIG. 3D. These deflectors 149 are configured to redirect the radial airflow (from the interior fan impeller 134, not shown) to the first air duct 150 and second air duct 160 (and eventually out of the first air outlet 111 and second air outlet 112 along the first direction 113 and the second direction 114, correspondingly). It should be noted that, absent the presence of any flow features downstream of the interior fan impeller 134 (such as fan shrouds, deflectors, ducts, louvers, etc), the interior fan impeller 134 would provide a uniform distribution of air around the entire circumference (defined as the outermost points on the interior fan impeller 134). At the same time, in some examples, the first air outlet 111 and second air outlet 112 are shaped as parallel slots along the first side 121 and second side 122 respectively. The protruding deflectors 149 help to redirect/focus the air toward the first air duct 150 and second air duct 160 leading to the first air outlet 111 and second air outlet 112.

Examples of Fan Impellers

In some examples, the interior fan impeller 134 is configured to direct all air passing through the interior fan impeller 134 in the directions substantially perpendicular to the principal axis 109. For example, the interior fan impeller 134 may be a backward curved centrifugal fan. This type of impeller is advantageous for the window heat pump 100 because the backward curved centrifugal fan ejects air nearly radially along the entire circumference of the fan, allowing air to flow outwards through the first air outlet 111 and second air outlet 112. Another advantage of the backward curved centrifugal fan is its ability to sustain a high back pressure, which enables the use of a high-MERV filter as further described below. In some examples, the interior fan impeller 134 has a diameter of 100-400 mm or, more specifically, 250-300 mm. In the same or other examples, the interior fan impeller 134 has a depth/thickness of 30-120 mm or, more specifically, 70-90 mm. The ratio of the diameter to depth/thickness can be 2-4 or, more specifically, 2.5-3.5.

Examples of Louvers

Referring to FIGS. 1B and 2A, in some examples, the interior portion 101 comprises a first set of louvers 159 positioned within the first air duct 150 and configured to control the flow rate of the first portion of air through the first air duct 150. For example, when aligned parallel to the first axis, the first set of louvers 159 may provide the least restriction to the airflow through the first air duct 150 thereby maximizing the flow rate. It should be noted that the flow rate also depends on the rotation speed of the interior fan impeller 134 (which can be controlled) and, in some examples, the position of the second set of louvers 169 in the second air duct 160.

In some examples, the first set of louvers 159 is accessible through the first air outlet 111 and is manually adjustable. Alternatively, the first set of louvers 159 may be adjustable using an actuator (motor), e.g., based directly on the input from the user interface 178 or based on other aspects of the system operation, such as operating in cooling vs heating mode. In either case, the first set of louvers 159 may comprise multiple louvers that are collectively pivotable for controlling both the flow rate of the first portion of air through the first air duct 150 and the first direction 113. An additional feature of louvers is to prevent accidental contact of a foreign object with the interior fan impeller 134. Specifically, the first set of louvers 159 may restrict access to the first air duct 150 and prevent contact with the interior fan impeller 134.

Referring to FIG. 2A, in some examples, the interior portion 101 comprises a second set of louvers 169 positioned within the second air duct 160. The second set of louvers 169 may be fixed or movable, e.g., configured to control a flow rate of the second portion of air through the first air duct 160. In more specific examples, the second set of louvers 169 is pivotable about one or more axes, each being perpendicular to the principal axis 109. The second set of louvers 169 may be manually actuatable or may be actuated using a motor. When the second set of louvers 169 is fixed, the second set of louvers 169 serves to straighten the airflow as the airflow exits the second air outlet 112 and improves the structural integrity of the enclosure and ducts. In either case, fixed or movable, the louvers prevent accidental contact of a foreign object with the interior fan impeller 134.

Overall, louvers may be used in the first/top and/or second/bottom vents to direct airflow up/down and/or left/right. Any combination of this up/down and/or left/right adjustability for each of the first set of louvers 159 and the second set of louvers 169 is within the scope. For example, the first set of louvers 159 may direct the airflow left-right. If the first set of louvers 159 is pivoted all the way to the left or all the way to the right, the first set of louvers 159 can also close off the majority of the airflow coming from the first air outlet 111. This configuration may be desirable when the window heat pump 100 is operating in a heating mode (in order to force hot air along the floor of the room so that it then rises into the occupied area, and in order to prevent air from blowing towards occupants' torsos). In some examples, the second set of louvers 169 may have two positions, e.g., one position pointing along the airflow direction with minimal airflow resistance, and another position nearly perpendicular to the airflow that blocks the majority of the lower outlet. For example, it may be desirable to block the second air duct 160 when the window heat pump 100 is in a cooling mode to force cold air upwards so that it falls down into the occupied space rather than pooling on the floor, and to prevent cold air from being blown towards the lower portion of occupants' bodies.

When the first set of louvers 159 and/or the second set of louvers 169 are actuated using motors, the louvers may move in response to other inputs to the user interface 178, e.g., closing the first air outlet 111 automatically in a heating mode, closing the second air outlet 112 automatically in cooling mode, or having the louvers point towards occupants in the room based on occupant sensors.

In some examples, the first set of louvers 159 and/or the second set of louvers 169 are actuated automatically using a system controller 170 that sets position based on air temperature, ambient temperature, air flow rate, etc.

Filter Examples

In some examples, the interior portion 101 further comprises a filter 130 such that the interior heat exchanger 132 is positioned between the filter 130 and the interior fan impeller 134. In some examples, the filter 130 has a minimum efficiency reporting value (MERV) of at least 7, at least 9, at least 11, at least 13, at least 15, or even at least 17 (e.g., high efficiency particulate air (HEPA) filters). As noted above, the use of such filters is enabled by a backward curved centrifugal fan, which supports significant airflow with a high back pressure (in comparison to other types of fan impellers/blades that suffer from significantly reduced airflow and/or significantly increase fan power consumption under the application of high back pressure). It should be noted that room air conditioners and ductless split heat pumps are typically only offered with low-MERV filters such as MERV 2. In cases where such conventional systems are offered with high-MERV filters, these systems suffer from reduced efficiency due to the reduced airflow and/or increased fan power consumption that results from their use of a different type of fan impeller/blade such as a crossflow fan or forwards curved centrifugal fan.

Additional Examples of Air Inlets and Outlets

In various examples described above, all inlets and outlets are positioned on the third side 123. Some benefits of such examples include, but are not limited to, using the first side 121 as a shelf and aligning the second direction 114 substantially parallel to the floor 192 (e.g., less than 20° off from the floor surface). However, other examples are also within the scope.

Figure 4A:
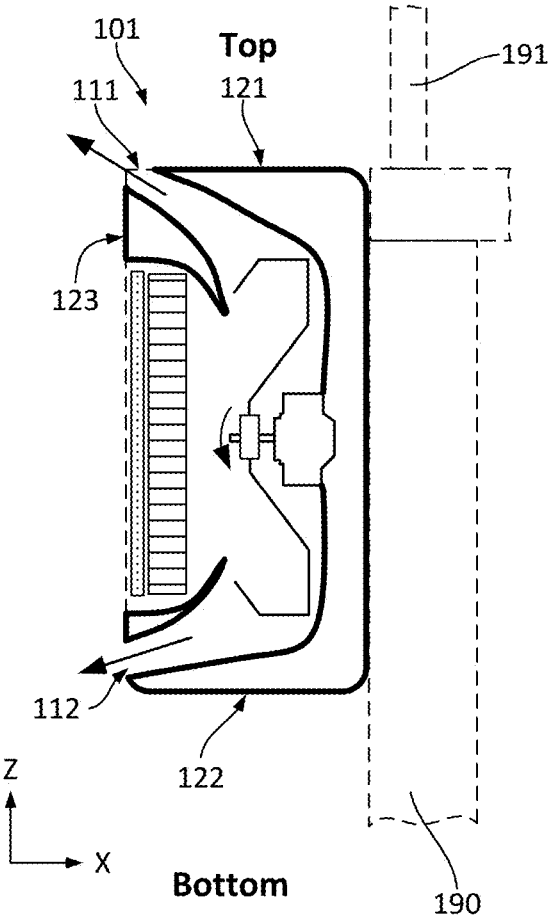
FIGS. 4A and 4B are cross-sectional side views of two examples of the interior portion illustrating different positions of the first and second air outlets.

Referring to FIG. 4A, in some examples, the first air outlet 111 is positioned at the corner between the first side 121 and the third side 123. This example potentially simplifies the design of the first air duct 150, may reduce the airflow resistance of the first air duct 150, and may allow for reducing the thickness of the interior portion 101 (e.g., potentially eliminating the need for the second bend).

Figure 4B:
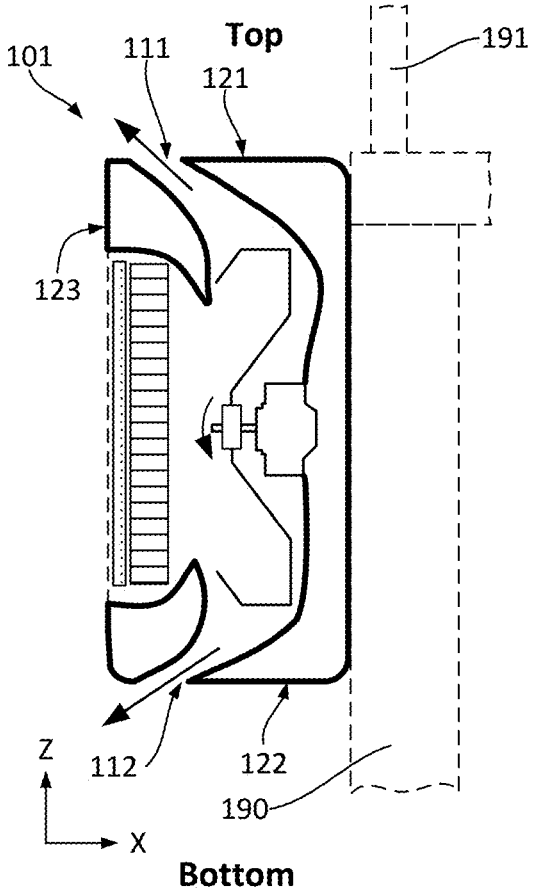

Referring to FIG. 4B, in some examples, the first air outlet 111 is positioned at the first side 121, while the second air outlet 112 is positioned at the second side 122. As noted before, this example may simplify the design of the first air duct 150 and the second air duct 160, may reduce the airflow resistance through either or both of these ducts and may allow reducing the thickness of the interior portion 101.

Figure 4C:
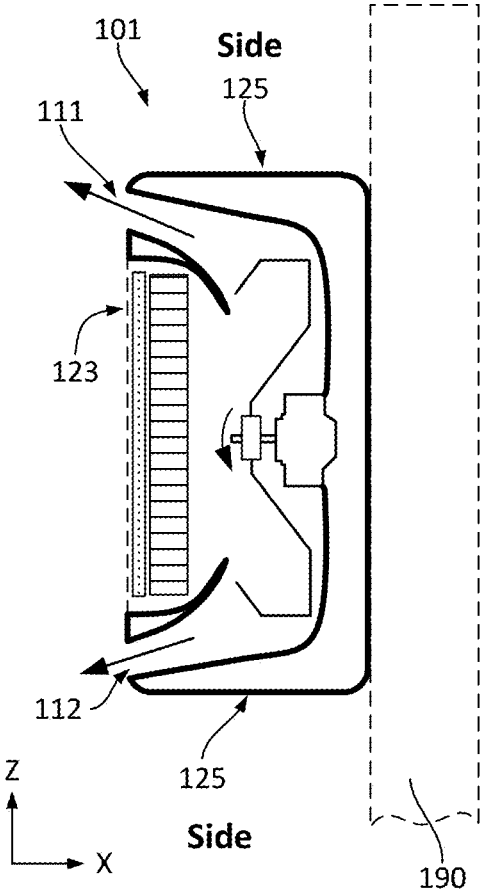
FIGS. 4C and 4D are cross-sectional top views of two additional examples of the interior portion illustrating different positions of the first and second air outlets.
Figure 4D:
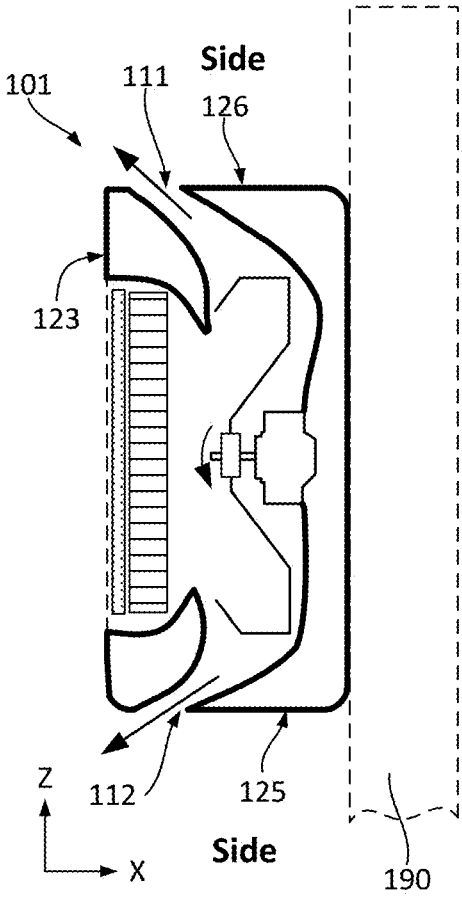

FIGS. 4C and 4D are cross-sectional top views of two additional examples of the interior portion 101 illustrating different positions of the first air outlet 111 and the second air outlet 112. In these examples, the first air outlet 111 and the second air outlet 112 extend perpendicular to the first side 121 and the second side 122 (rather than extending parallel to these sides as, e.g., is shown in FIG. 1B). In the example of FIG. 4C, the first air outlet 111 and the second air outlet 112 are still positioned at the third side 123. In the example of FIG. 4D, first air outlet 111 and second air outlet 112 are positioned at the fifth side 125 and sixth side 126, respectively.

Figure 5A:
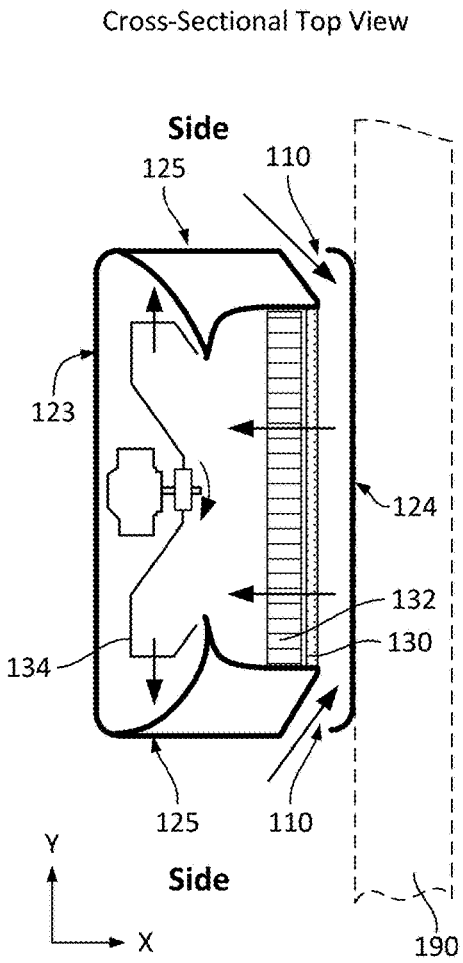
FIGS. 5A and 5B are cross-sectional side and top views of the same interior portion illustrating the position of air inlets (in FIG. 5A) and air outlets (in FIG. 5B), in accordance with some examples.
Figure 5B:
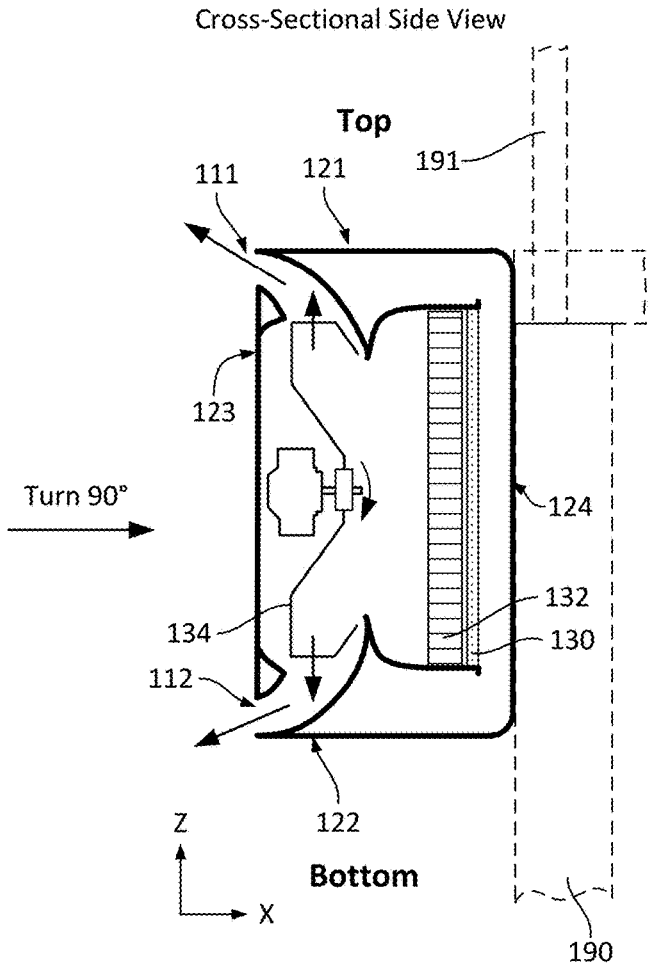

FIGS. 5A and 5B are cross-sectional side and top views of the same interior portion 101 illustrating the position of air inlets 110 (in FIG. 5A) as well as the first air outlet 111 and second air outlet 112 (in FIG. 5B), in accordance with some examples. This configuration allows to position of the filter 130 and interior heat exchanger 132 between the building wall 190 and interior fan impeller 134. This configuration separates the air inlet and outlet by a greater distance, which reduces the risk of air recirculating from the air outlet back to the air inlet and bypassing the majority of the room.

Overall, the first air outlet 111 and second air outlet 112 may be positioned at different angles depending on the geometric constraints of the window heat pump 100 or, more specifically, the interior portion 101 and the intended installed geometry/location of the interior portion 101 in the room, and the desired airflow back pressure properties. For example, the first air outlet 111 may exit through the first side 121 rather than the third side 123 or through the corner formed by the first side 121 and third side 123. In the same or other examples, the second air outlet 112 may be positioned at the second side 122 (rather than the third side 123) or through the corner formed by the second side 122 and the third side 123. The interior heat exchanger 132 may be located along the fourth side 124 rather than the third side 123 with airflow being drawn into the back of the interior portion 101 (e.g., along the building wall 190) instead of into the front. The first air outlet 111 and second air outlet 112 on the sides (i.e., the fifth side 125 and sixth side 126) of the interior portion 101, potentially with louvers that angle the airflow upwards, downwards, towards the wall, or away from the building wall 190. Some of these geometries may reduce the amount of recirculated air in the room (in other words, air that exits the unit and then reenters the interior portion 101 before conditioning a substantial portion of the room).

Experimental Results

A series of experiments was conducted to determine the performance of a window heat pump with various types of filters. In the first experiment, the heat pump was equipped with two types of high efficiency particulate air (HEPA) filters (both having a MERV rating of at least 17) and operated in a fan-only mode. The first filter type had a thickness of 45 mm, while the second filter type had a thickness of 20 mm. A conventional box-style air purifier was used as a reference. The conventional air purifier had two air inlets (on the sides) and one air outlet (on the top). The test results are presented in the table below. Despite similar flow rates, the heat pump in fan-only mode demonstrated substantially lower (by 20-35%) power draw than the air purifier. Without being restricted to any theory, it is believed that multiple design features caused such a reduction in required power. One factor is a backward curved centrifugal fan. Another factor is the air duct design described above.

| Metric | Air Purifier with HEPA | Heat Pump with 45-mm HEPA | Heat Pump with 20-mm HEPA |
|---|---|---|---|
| Air Flow Rate (CFM) | 416 | 400 | 350 |
| Noise Level (dBA) | 22-52 | 37-60 | 37-65 |
| Power Draw (W) | 66 | 42 | 53 |

These tests show the efficacy of this airflow design in handling the high flow resistances required to effectively drive air through high-efficiency filters. As a result, air purification capabilities can be added to heat pumps following this design, thus enabling multiple functionalities (heating/cooling and air filtration). It should be noted that if the heat pump were being operated in heating or cooling mode (as opposed to fan-only mode), the fan would still consume power. As such, effective energy savings would be measured relative to a heat pump plus standalone air filter counterfactual and would therefore be greater. In addition, combining high MERV air filtration with heating and cooling prevents the need to have a standalone air filter including the space and equipment cost associated with that additional appliance.

In a further experiment, the indoor fan noise was modeled for different types of filters. The results are presented in the table below. A decibel difference less than 3 dBA is generally considered to be imperceptible, so this data shows that a MERV 13 filter plus carbon prefilter of equivalent thickness, or a thicker HEPA filter, can be substituted for the MERV 2 filter with negligible noise impact.

| Filter Type | indoor fan noise [dBA] |
|---|---|
| 20-mm MERV 2 | 60.5 |
| 20-mm MERV 13 with carbon prefilter | 61.5 |
| 20-mm HEPA | 67.5 |
| 45-mm HEPA | 62.5 |

Another comparison involved modeling the coefficient of performance (COP) of a window heat pump with different types of filters at an outdoor temperature of −8° C. (17° F.) and an indoor temperature of 21° C. (70° F.) and a capacity of approximately 9000 BTU/hr. COP was assessed at both constant air flow rate and constant motor speed. The results are presented in the table below. The results show that as the filter effectiveness increases, the COP of the heat pump decreases. It should be noted that thicker filters (of a given effectiveness) can mitigate the COP reduction due to the increased surface area of these pleated filters. However, by selecting the correct change to operation (in this case, increasing the motor speed to maintain the air flow rate) the degradation in performance can be reduced to below 1% for the 20-mm MERV 13 with carbon prefilter.

| Filter Type | COP (Constant Air Flow) | COP (Constant Motor Speed) |
|---|---|---|
| 20-mm MERV 2 | 2.45 | 2.45 |
| 20-mm MERV 13 with carbon prefilter | 2.44 | 2.40 |
| 20-mm HEPA | 2.38 | 2.18 |
| 45-mm HEPA | 2.43 | 2.36 |

CONCLUSION

Although the foregoing concepts have been described in some detail for purposes of clarity of understanding, it will be apparent that certain changes and modifications may be practiced within the scope of the appended claims. It should be noted that there are many alternative ways of implementing processes, systems, and apparatuses. Accordingly, the present embodiments are to be considered illustrative and not restrictive.

The invention claimed is:

1. A window heat pump comprising:

an interior portion comprising an interior heat exchanger, an interior fan impeller, a first side, a second side opposite the first side, a third side extending between the first side and the second side, and an interior motor configured to rotate the interior fan impeller about a principal axis;

an exterior portion comprising a compressor, an exterior heat exchanger, and an exterior fan impeller and offset relative to the interior portion along the principal axis; and an interconnecting portion extending between the interior portion and the exterior portion along the principal axis and mechanically, fluidically, and electrically interconnecting the interior portion and the exterior portion, wherein:

each of the interior portion and the exterior portion extend away from the interconnecting portion in a direction perpendicular to the principal axis, the principal axis extends between the first side and the second side and through the third side, the first side is substantially parallel with the principal axis and is positioned closer to the interconnecting portion than the second side is positioned, the interior portion further comprises a first air outlet, a second air outlet, and an air inlet such that the interior heat exchanger and the interior fan impeller are positioned on a fluidic pathway between the air inlet and each of the first air outlet and the second air outlet, the first air outlet is positioned closer to the first side than to the second side, the second air outlet is positioned closer to the second side than to the first side, the interior portion further comprises a first set of louvers positioned within the fluidic pathway between the interior fan impeller and the first air outlet, the first air outlet is configured to direct a first portion of air exiting the interior portion along a first direction, the second air outlet is configured to direct a second portion of air exiting the interior portion along a second direction, and the first direction is not parallel to the second direction.

2. The window heat pump of claim 1, wherein:

the first direction extends away from the principal axis and toward the first side, and the second direction extends away from the principal axis and toward the second side.

3. The window heat pump of claim 2, wherein:

the first direction forms an angle of 30-60° with the principal axis, and the second direction forms an angle of 0-20° with the principal axis.

4. The window heat pump of claim 2, wherein:

the first side is positioned closer to the first air outlet than to the second air outlet, and the second side is positioned closer to the second air outlet than to the first air outlet.

5. The window heat pump of claim 4, wherein the air inlet is provided on the third side.

6. The window heat pump of claim 5, wherein the air inlet is positioned between the first air outlet and the second air outlet.

7. The window heat pump of claim 4, wherein at least one of the first air outlet and the second air outlet is provided on the third side.

8. The window heat pump of claim 4, wherein both the first air outlet and the second air outlet are provided on the third side.

9. The window heat pump of claim 1, wherein the interior portion comprises:

a first air duct defining a fluidic path between the interior fan impeller and the first air outlet, and a second air duct defining a fluidic path between the interior fan impeller and the second air outlet.

10. The window heat pump of claim 9, wherein:

the interior fan impeller is configured to direct the first portion of air into the first air duct in a direction substantially perpendicular to the principal axis, and the interior fan impeller is configured to direct the second portion of air into the second air duct in a direction substantially perpendicular to the principal axis.

11. The window heat pump of claim 9, wherein the interior fan impeller is of a backward curved centrifugal type.

12. The window heat pump of claim 9, wherein the first set of louvers is positioned within the first air duct and is configured to control a flow rate of the first portion of air through the first air duct.

13. The window heat pump of claim 12, wherein the first set of louvers is accessible through the first air outlet, is manually adjustable, and collectively pivotable.

14. The window heat pump of claim 12, wherein the first set of louvers restrict access to the first air duct and prevent contact with the interior fan impeller.

15. The window heat pump of claim 9, wherein the interior portion comprises a second set of louvers positioned statically within the second air duct and configured to prevent contact with the interior fan impeller.

16. The window heat pump of claim 9, wherein the interior portion comprises a second set of louvers pivotably supported within the second air duct.

17. The window heat pump of claim 9, wherein a first line, which is defined by an inner surface of the first air duct and spaced furthest away from the principal axis, is defined by two bends.

18. The window heat pump of claim 9, wherein a second line, which is defined by an inner surface of the second air duct and spaced furthest away from the principal axis, is defined by one bend.

19. The window heat pump of claim 1, wherein:

the interior portion further comprises a filter such that the interior heat exchanger is positioned between the filter and the interior fan impeller, and the filter has a minimum efficiency reporting value of at least 13.

20. The window heat pump of claim 1, wherein the interior portion further comprises a fan shroud surrounding the interior fan impeller and comprising two protruding deflectors.

* * * * *